US005717817A

United States Patent [19]

Brooks et al.

[11] Patent Number: 5,717,817

[45] Date of Patent: Feb. 10, 1998

[54] SYSTEM FOR STORING AND HANDLING WASTE MATERIALS

[76] Inventors: Tyrell J. Brooks; Clifton L. Brooks, Jr., both of 3104 N. Erie, Tulsa, Okla. 74115

[21] Appl. No.: 451,040

[22] Filed: May 25, 1995

[51] Int. Cl.[6] ..... H24H 1/20

[52] U.S. Cl. ..... 392/451; 392/339; 392/340

[58] Field of Search ..... 392/451, 339, 392/341, 441, 449, 456, 485; 219/213; 222/146.2, 146.5; 220/565

[56] References Cited

U.S. PATENT DOCUMENTS

| | | | |
|---|---|---|---|
| 1,633,458 | 6/1927 | Schock | 220/565 |
| 2,721,928 | 10/1955 | Boydstun | 219/38 |
| 2,802,520 | 8/1957 | Trabilcy | 137/341 |
| 2,888,545 | 5/1959 | Kinney | 392/441 |
| 2,894,102 | 7/1959 | Morris | 219/19 |
| 3,206,077 | 9/1965 | Fetterman | 222/135 |
| 4,191,524 | 3/1980 | Thorn | 222/146.5 |
| 4,360,046 | 11/1982 | Streit et al. | 141/82 |
| 4,568,821 | 2/1984 | Boe | 392/441 |
| 4,661,684 | 4/1987 | Sellers | 392/456 |
| 4,733,650 | 3/1988 | Triggs | 126/343.5 |
| 4,844,927 | 7/1989 | Morris et al. | 426/307 |
| 4,955,594 | 9/1990 | Angelone | 220/565 |
| 5,033,637 | 7/1991 | Webb | 220/565 |
| 5,093,896 | 3/1992 | Moore et al. | 392/441 |

*Primary Examiner*—Tu B. Hoang

*Attorney, Agent, or Firm*—Fellers, Snider, Blankenship, Bailey & Tippens

[57] ABSTRACT

A system which is particularly well suited for the storage and disposal of reclaimable oil and grease materials resulting from food preparation operations. The system utilizes a storage apparatus associated with a building. The apparatus preferably comprises: a container positioned outside of the building; an inlet conduit for conducting the material to the container; and an outlet conduit for conducting the material from the container. Each of the inlet and outlet conduits preferably has a first end positioned inside the building and a second end connected to the container.

22 Claims, 6 Drawing Sheets

SYSTEM FOR STORING AND HANDLING WASTE MATERIALS

FIELD OF THE INVENTION

The present invention relates to apparatuses and methods for temporarily storing and handling waste materials. More particularly, but not by way of limitation, the present invention relates to apparatuses and methods for temporarily storing and handling reclaimable waste materials such as waste oils and greases resulting from food preparation operations.

BACKGROUND OF THE INVENTION

As will be appreciated by those skilled in the art, restaurants and other food preparation facilities must dispose of substantial quantities of oils, greases, and other fatty materials. Typically, such waste materials are disposed of by: (a) collecting the materials from deep fryer vats and other repositories; (b) physically carrying the collected material to an outdoor storage area; and then (c) pouring the material into a drum or into some other type of container. Subsequently, the stored material is hauled to a reclamation facility by either (a) loading and transporting the individual storage container or (b) dumping the stored material out of the container and into a specially adapted transport vehicle.

This disposal method has numerous shortcomings. Since restaurant workers must physically carry the material to the storage site and then deliver the material into the storage container, the potential for spills, burns, and other serious injuries is quite high. Additionally, restaurant workers are placed in significant danger by having to open the back door of the restaurant and carry the collected material outside, particularly in light of the fact that such disposal operations are typically performed either early in the morning or late at night. Further, since the stored material has significant economic value, theft of the stored material is quite common.

A proposed alternative disposal system is described in U.S. Pat. No. 4,360,046, issued to Streit et al. The Streit et al. disposal system utilizes a storage unit which can optionally be positioned inside the restaurant. The Streit et al. storage unit includes: a top opening for introduction of collected fatty materials; a valved outlet, provided at the bottom of the unit, to which a vacuum truck hose can be connected; a spring-loaded lid which is operated by means of a foot pedal; and an immersion-type, thermostatically controlled, electric heater provided in the bottom of the unit for maintaining the stored material in a fluid state. It is suggested that the Streit et al. storage unit can optionally include a pump and a hose reel positioned in the top thereof for pumping greases and fats from deep frying wells into the storage unit.

Unfortunately, the Streit et al. disposal system also has significant shortcomings. First, although placing the Streit et al. storage unit inside the restaurant substantially alleviates theft problems and ensures that restaurant workers will not have to open the back door of the restaurant and walk outside during the disposal operation, placing the storage unit inside the restaurant takes up valuable space. Additionally, the storage of hot oil and grease inside the restaurant presents significant sanitation, odor, and safety problems. Moreover, even if the Streit et al. unit can be operated inside the restaurant in a manner sufficient to comply with health and safety regulations, such operation would require substantial care and effort.

As is thus apparent, a need presently exists for a grease and oil disposal system which: (a) substantially eliminates the physical handling of hot oil and grease materials by restaurant workers, (b) allows the oil and grease material to be stored outside of the restaurant, (c) substantially eliminates theft problems, and (d) allows the oil and grease material to be transferred to the outside storage area without having to open the back door of the restaurant and without requiring restaurant workers to walk outside.

SUMMARY OF THE INVENTION

The present invention provides a storage and handling system which alleviates the problems and satisfies the needs discussed hereinabove.

In one aspect, the present invention provides a storage apparatus associated with a building wherein the building has a building wall. The apparatus comprises: a container positioned outside of the building; an inlet means, extending from the container and through the building wall, for delivering a material into the container; and an outlet means, extending from the container and through the building wall, for removing the material from the container.

In another aspect, the present invention provides a storage apparatus associated with a building wherein the apparatus comprises: a container positioned outside of the building; an inlet conduit means for conducting a material to the container; and an outlet conduit means for conducting the material from the container. Each of the inlet and outlet conduit means extends from the container and includes either an inlet or an outlet positioned inside the building.

In another aspect, the present invention provides a method of handling a material. The inventive method comprises the steps of: (a) placing the material in a container positioned outside of a building and (b) removing the material from the container. The container is included in a storage apparatus which further comprises an inlet conduit means for conducting the material to the container and an outlet conduit means for conducting material from the container. Each of the inlet and outlet conduit means extends from the container and has either an inlet or an outlet positioned inside the building. The material is placed in the container in step (a) by delivering the material into the inlet of the inlet conduit means. The material is removed from the container in step (b) by conducting the material through the outlet conduit means.

The inventive method just described can also include the steps, prior to step (b), of (1) extending a third conduit means into the building and (2) securing the third conduit means to the outlet of the outlet conduit means. The third conduit means is preferably operable for conducting the material from the outlet conduit means to a transporting means, positioned outside of the building, for transporting the material. Further, the material will preferably be removed from the container in step (b) by pumping the material through the third conduit means and into the transporting means using a vacuum pump.

In yet another aspect, the present invention provides a method which utilizes an underground container for handling a waste fatty material resulting from a food preparation operation. The container is positioned outside of a building and is included in a storage apparatus which further comprises an inlet conduit means for conducting the waste fatty material to the container. The inlet conduit means extends from the container and includes an inlet positioned inside the building. The method comprises the step of placing the waste fatty material in the container by delivering the material into the inlet of the inlet conduit means.

Further objects, features and advantages of the present invention will be apparent to those skilled in the art upon reference to the accompanying drawings and upon reading the following description of the preferred embodiments.

DESCRIPTION OF THE PREFERRED EMBODIMENTS

Figure 1:
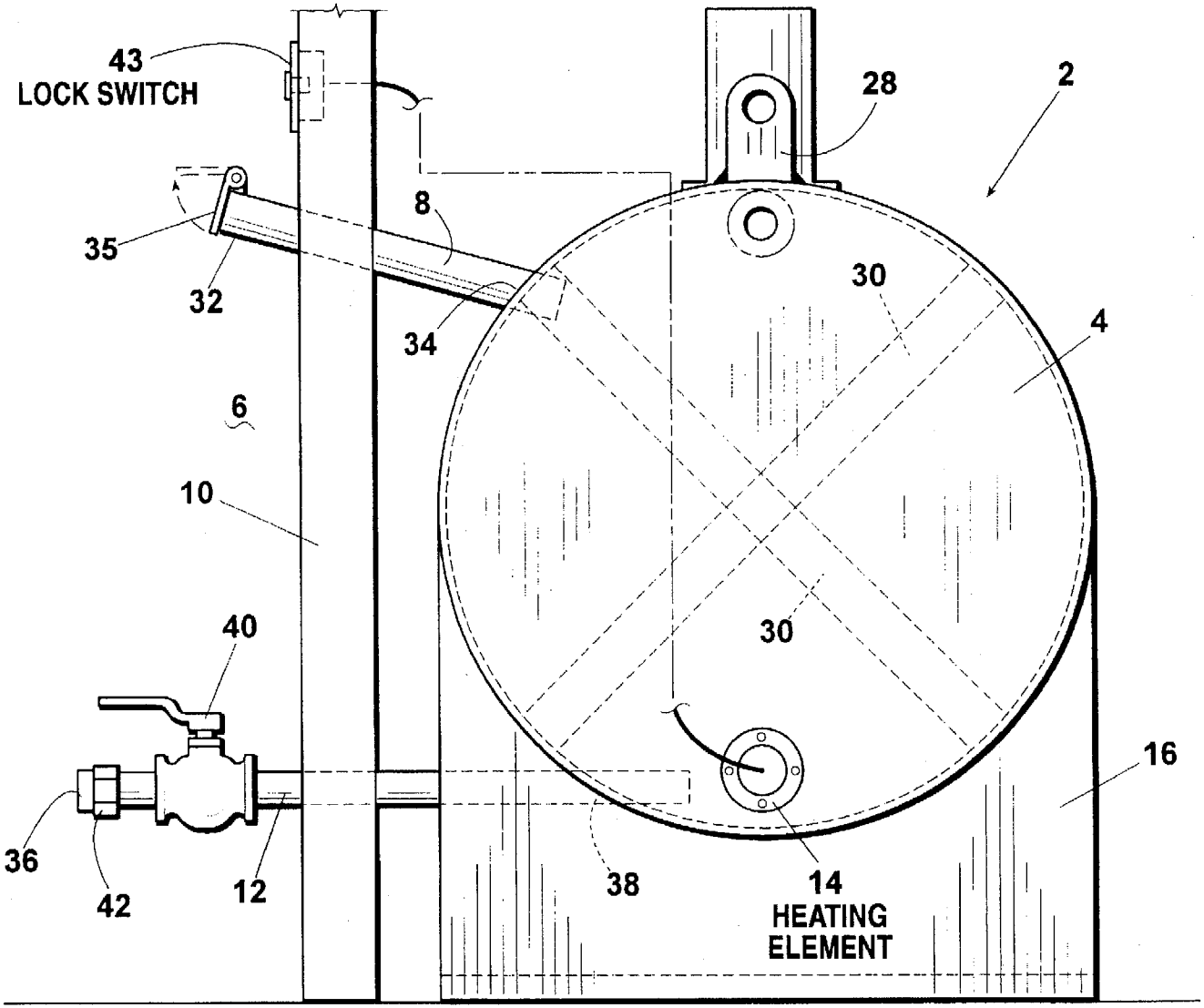
FIG. 1 provides an elevational end view of an embodiment 2 of the storage apparatus provided by the present invention.
Figure 2:
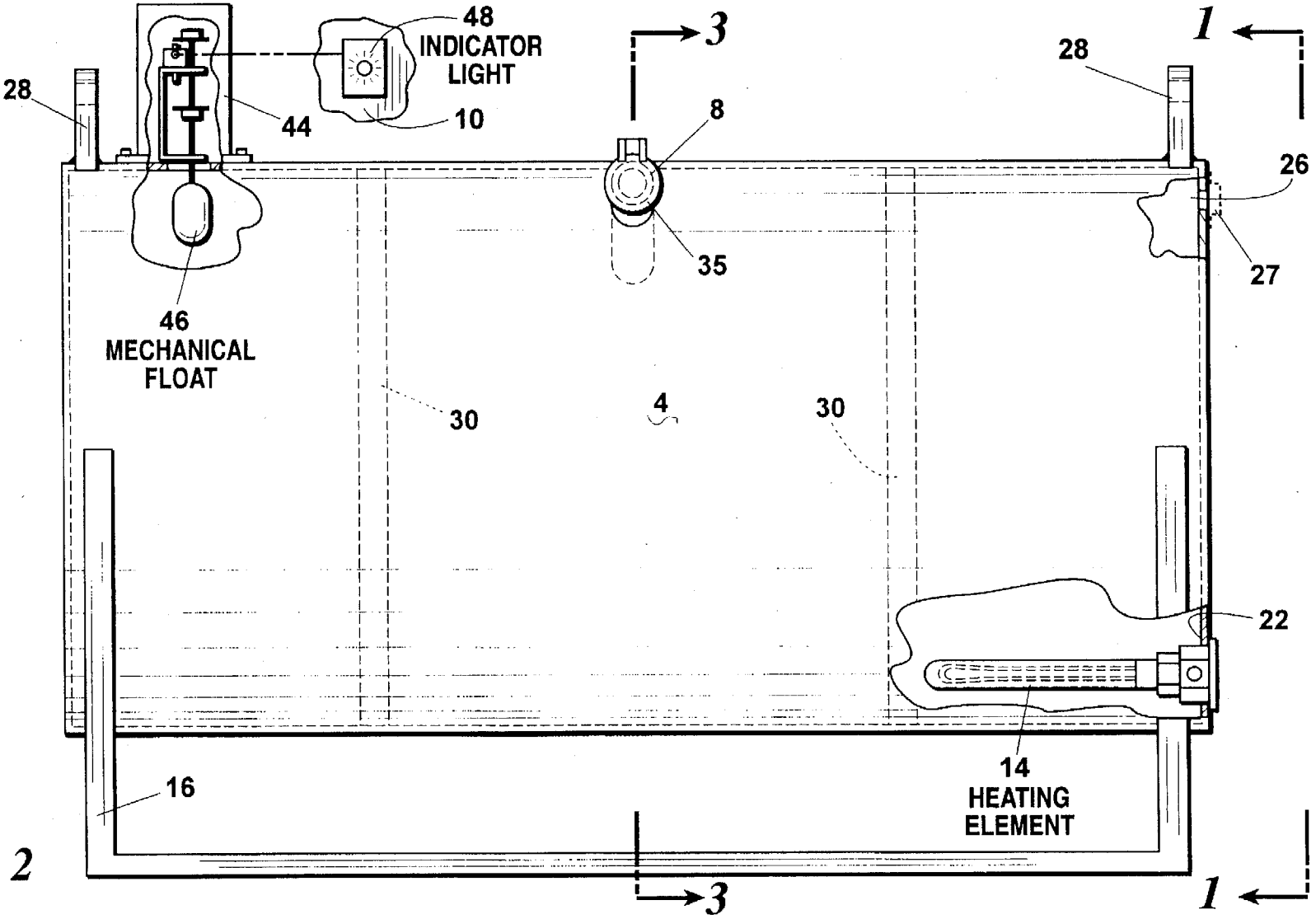
FIG. 2 provides an elevational side view of inventive apparatus 2.
Figure 3:
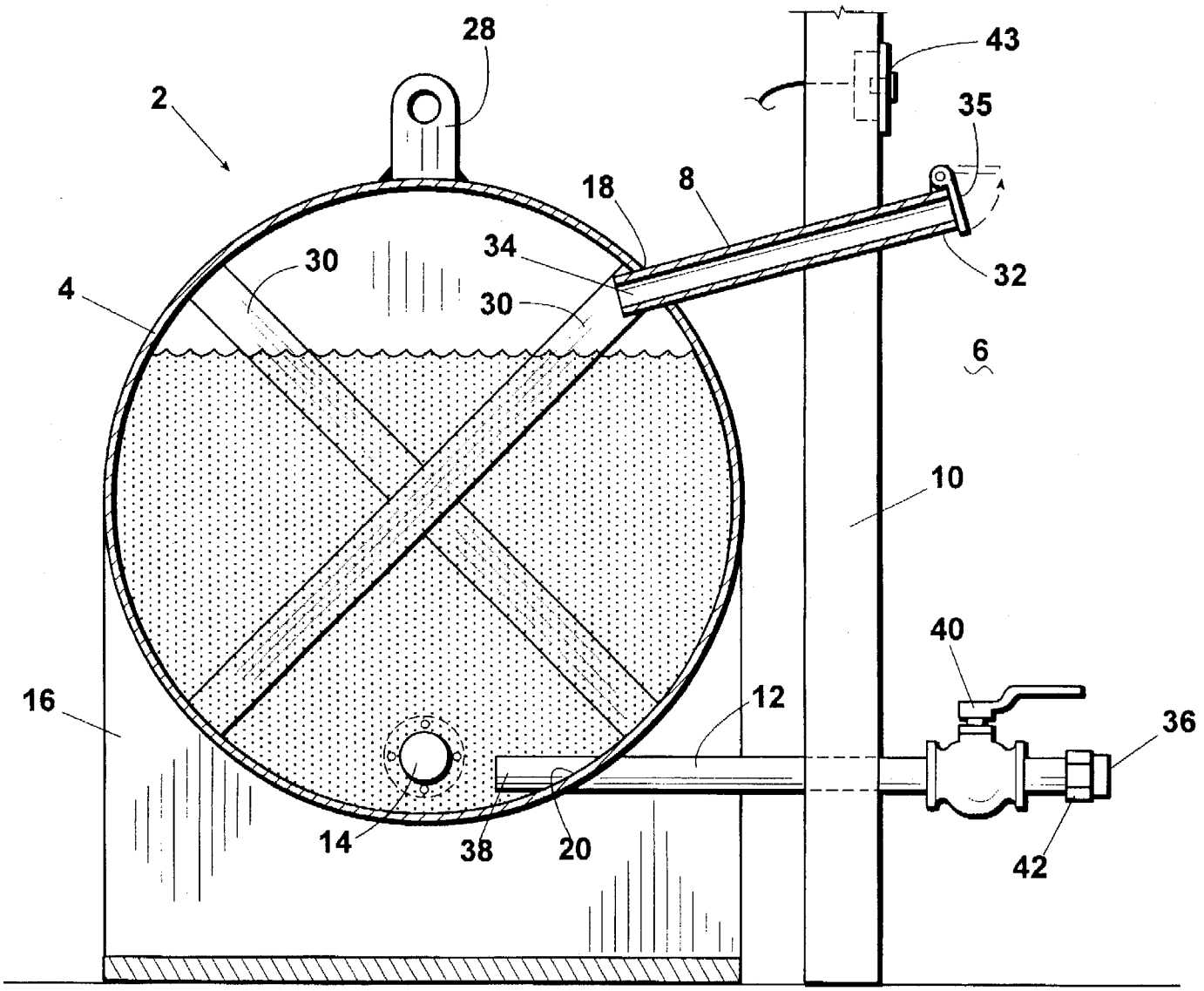
FIG. 3 provides a cutaway, elevational end view of inventive apparatus 2 taken from perspective 3—3 shown in FIG. 2

An embodiment 2 of the inventive material storage apparatus is depicted in FIGS. 1–3. Inventive apparatus 2 comprises: a container 4 positioned outside of a building 6; an inlet conduit 8 extending into building 6; an outlet conduit 12 extending into building 6; and a heating element 14 which is operable for heating the contents of container 4. Building 6 includes a wall 10.

Container 4 is preferably a cylindrical vessel supported on a frame 16. Container 4 preferably includes: an inlet port 18 provided at or near the top of container 4; an outlet port 20 provided near the bottom of container 4; a heating element port 22 provided at or near the bottom of an end of container 4; a vent hole 26 for providing pressure and vacuum relief; a screen or similar means 27 covering vent hole 26; and a pair of lifting attachments 28 extending upward from the ends of container 4. As shown in FIG. 3, outlet port 20 is preferably located adjacent to heating element 14. Additionally, support braces 30 are preferably provided inside container 4 for adding structural strength to the inventive storage apparatus.

Inlet conduit 8 preferably comprises a fill pipe which extends through wall 10. Fill pipe 8 has an inlet 32 positioned inside building 6 and a second end portion 34 connected to container 4 at inlet port 20. The inlet end 32 of conduit 8 is preferably elevated with respect to second end 34 such that material delivered into first end 32 will gravitationally flow into container 4. Inlet end 32 of conduit 8 is preferably covered by an openable flapper plate 35. Additionally, although inlet conduit 8 is shown as extending through wall 10, conduit 8 could alternatively extend through the floor of building 6 or could extend into building 6 by other means.

Outlet conduit 12 is preferably also a pipe which extends into building 6 through building wall 10 or which extends into building 6 by other means. Outlet pipe 12 has an outlet end 36 positioned inside building 6 and a second end portion 38 connected to container 4 at outlet port 20. A valve 40 is preferably installed in outlet conduit 12 for selectively opening and closing the outlet conduit. Valve 40 is preferably a ball valve and is preferably positioned inside building 6. The positioning of outlet conduit 12 and valve 40 inside building 6 effectively prevents the theft of the material stored in container 4.

A standard quick-connect fitting 42 is preferably provided on the outlet end 36 of outlet conduit 12. The use of quick-connect fitting 42 substantially ensures that material cannot leak or spill from outlet conduit 12. As will be understood by those skilled in the art, standard quick-connect fittings are readily available from commercial manufacturers.

Heating element 14 is preferably a thermostatically controlled, electrical heating element installed through container port 22. Heating element 14 extends along a portion of the bottom of container 4. The thermostatic control for heating element 14 can be located either inside or outside of building 6. A key-operated lock switch 43, for turning heating element 14 on and off, is preferably provided inside building 6. Although heating element 14 is preferably an electrical heating element, it will be understood that a steam heating element, a steam blanket, an electrical blanket, a fired heating system, or generally any other type of heating system can be used for heating the contents of container 4. Electrical heating elements suitable for use in inventive apparatus 2 are available from Process Heating Company, Seattle, Wash., and from other commercial manufacturers.

Inventive apparatus 2 also preferably includes a level indicating system 44. System 44 can include, for example, a standard, mechanical float 46 positioned inside container 4 and an indicator light 48 located inside building 6. Alternatively, or in addition, generally any other type of electronic or other level indicating means can be used in inventive apparatus 2. In each case, a visual or audible level indicator (preferably a warning light or other visual level indicator) will preferably be located inside building 6.

When inventive apparatus 2 is used in conjunction with a restaurant or other food preparation operation, greases, used cooking oils, and/or other fatty waste materials will preferably be disposed of by pumping the materials from deep fryer fats and other repositories into the inlet of inlet conduit 8. The materials will thus accumulate and be stored in container 4. Periodically, or whenever a desired material level is reached, the material will preferably be removed from container 4 by (a) extending a hose or other conduit 50 into building 6 from a transport vehicle 52 (e.g. a vacuum truck), (b) connecting the end of the hose 50 to the quick-connect fitting 42 provided on the outlet of outlet conduit 12, (c) opening valve 40 and (d) conducting the material from container 4 to the transport vehicle 52 via outlet conduit 12 and via the transport vehicle hose 50. Most preferably, the material will be conducted from container 4 to the transport vehicle by means of a vacuum pump 51 provided on the transport vehicle 52. Additionally, prior to conducting the material from container 4 to the transport vehicle 52, heating element 14 will preferably be operated as necessary to place and maintain the contents of container 4 in a liquid condition suitable for pumping.

Figure 4:
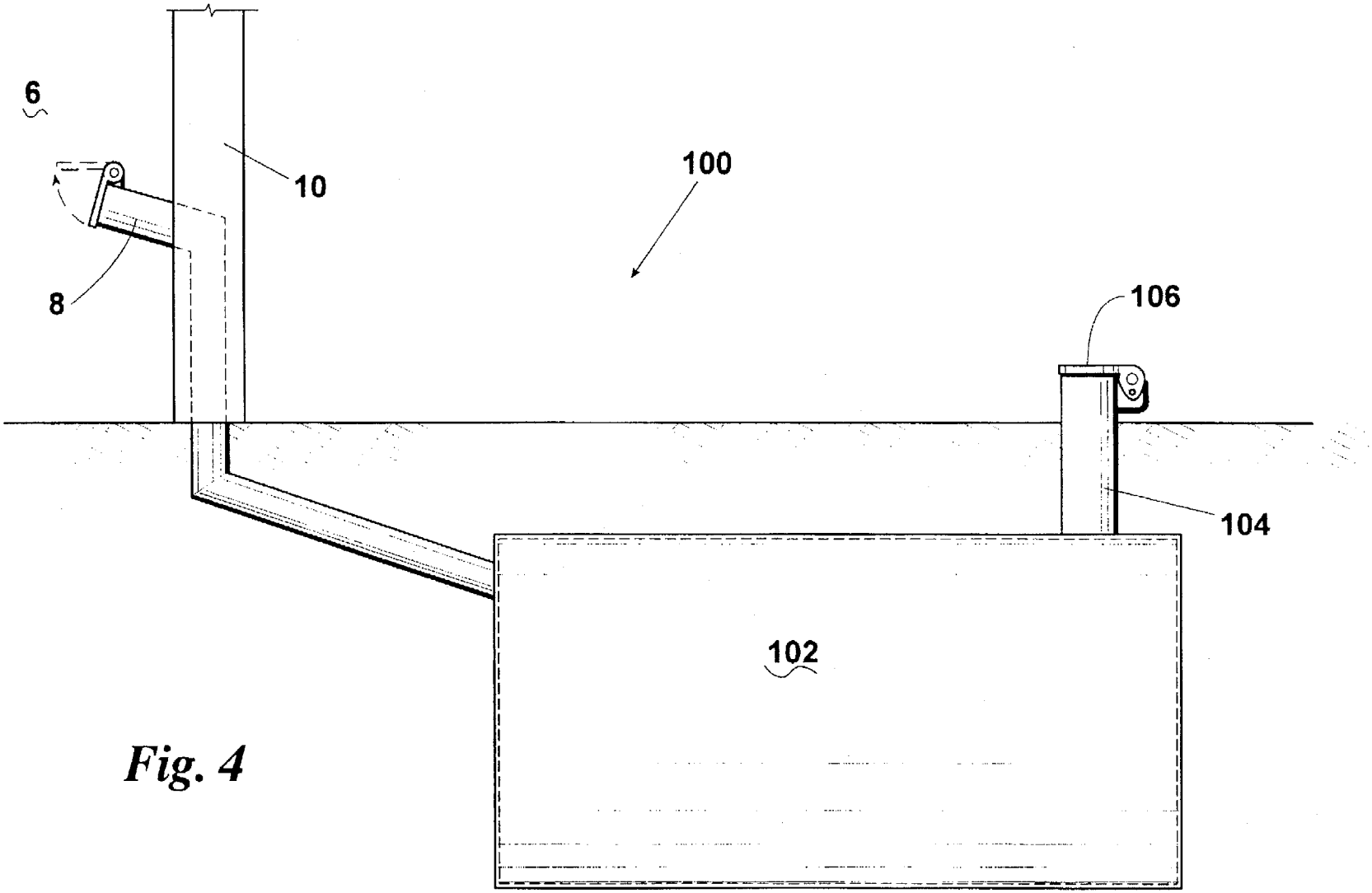
FIG. 4 provides a side view of a second embodiment 100 of the inventive storage apparatus. Embodiment 100 utilizes a storage container 102 positioned underground.
Figure 5:
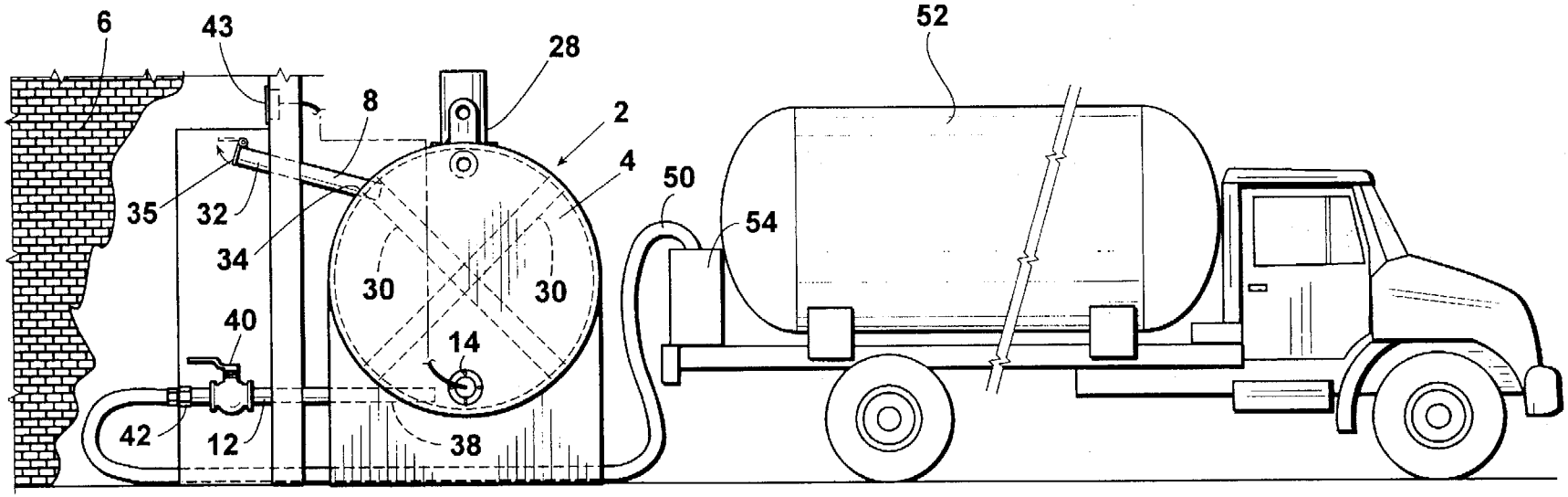
FIG. 5 illustrates the use of inventive apparatus 2 in accordance with the method of the present invention.
Figure 6:
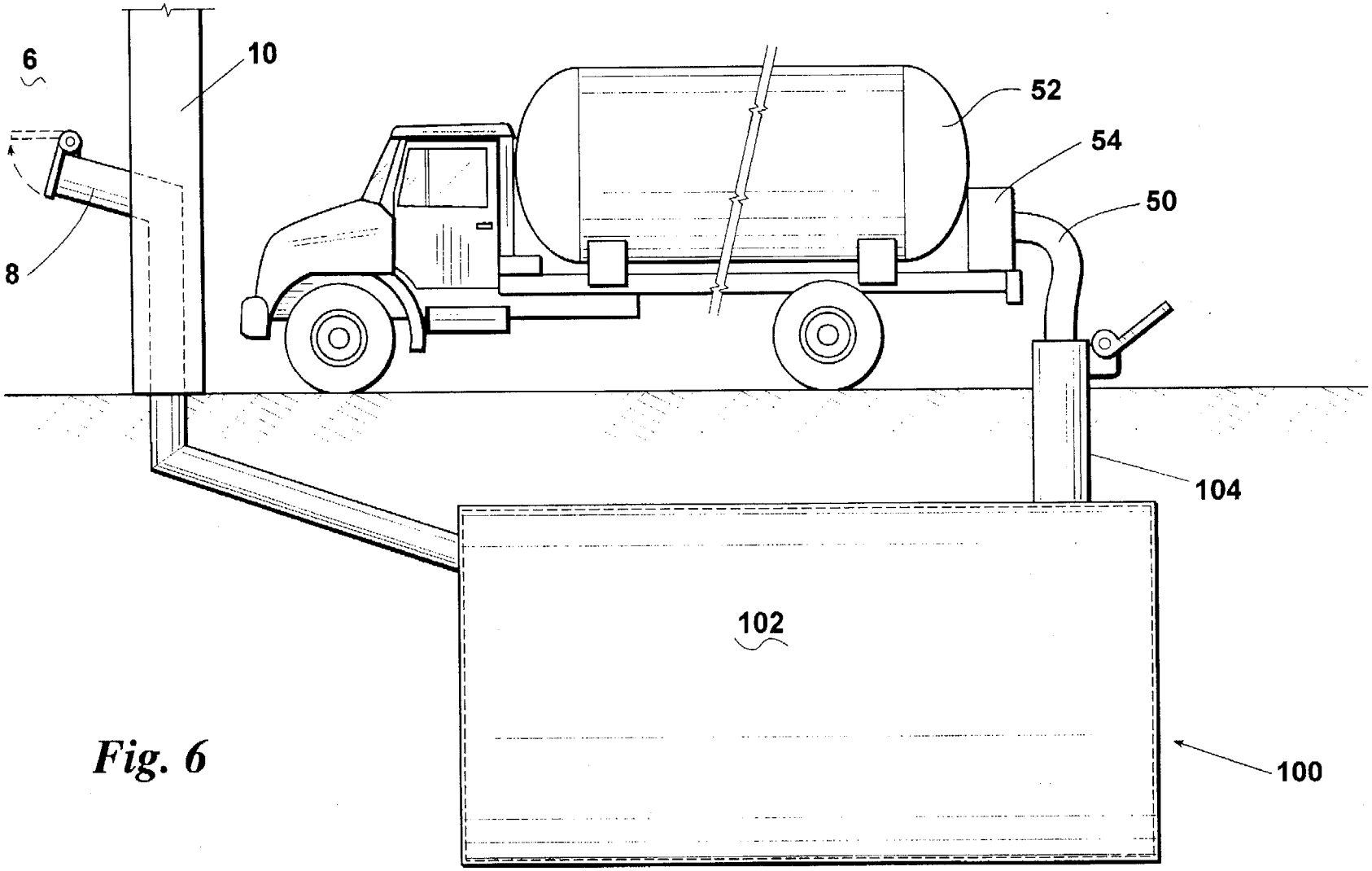
FIG. 6 illustrates the use of inventive apparatus 100 in accordance with the inventive method.

An alternative embodiment 100 of the inventive storage apparatus is depicted in FIG. 4. Inventive apparatus 100 utilizes an underground container 102. The remaining features of embodiment 100 will be essentially the same as the corresponding features of embodiment 2 except that the embodiment 100 typically will not include an outlet conduit which extends into building 6. Rather, embodiment 100 will typically include an outlet pipe 104 which extends from the top of container 102, is sized for receiving a vacuum truck hose 50, and is accessible by means of a lockable flapper type lid 106. The underground apparatus 100 typically will also not require the presence of a heating element 14.

The above-described embodiments of the inventive apparatus can advantageously be used for temporarily storing generally any type of liquid or liquefiable material. However, the inventive apparatus is particularly well suited for temporarily storing reclaimable materials such as restaurant oils and greases, as discussed hereinabove, and used motor oil.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A method of handling a material comprising the steps of:

(a) placing said material in a container positioned outside of a building, said container being included in a storage apparatus which further comprises:

an inlet conduit means for conducting said material to said container, said inlet conduit means extending from said container and having an inlet opening positioned inside said building and an outlet conduit means for conducting said material from said container, said outlet conduit means extending from said container and having an outlet opening positioned inside said building, wherein said material is placed in said container by delivering said material into said inlet opening of said inlet conduit means;

(b) temporarily extending a conduit into said building from a transporting vehicle, said transporting vehicle being positioned outside of said building;

(c) removably securing said conduit to said outlet opening of said outlet conduit means;

and (d) delivering said material from said container to said transporting vehicle via said outlet conduit means and said conduit.

2. The method of claim 1 wherein said material is delivered from said container to said transporting vehicle in step (d) by pumping said material using a vacuum pump.

3. The method of claim 1 further comprising the step, after step (a) and prior to step (d) of heating said material while said material is present in said container.

4. The method of claim 1 wherein said material is a waste fatty material resulting from a food preparation operation.

5. The method of claim 1 wherein said material is used motor oil.

6. The method of claim 1 wherein said material is delivered into said inlet conduit means in step (a) by pumping said material into said inlet opening.

7. A storage apparatus comprising:

a container positioned outside of a building;

an inlet conduit means for conducting a material to said container, said inlet conduit means extending from said container and having an inlet opening positioned inside said building; and an outlet conduit means for conducting said material from said container, said outlet conduit means extending from said container and having an outlet opening positioned inside said building.

8. The storage apparatus of claim 7 further comprising a heating means for heating the material in said container, said heating means including a control means, located inside said building, for turning said heating means on and off.

9. The storage apparatus of claim 7 further comprising a level determining means for determining a material level in said container, said level determining means including an indicator located inside said building.

10. The storage apparatus of claim 7 wherein said connecting means is a quick-connect fitting is provided on said outlet opening of said outlet conduit means.

11. The storage apparatus of claim 7 where said outlet conduit means further comprises a valve for selectively and closing said outlet conduit means opening, said valve being positioned inside said building.

12. The storage apparatus of claim 7 wherein:

said building includes a building wall and said inlet conduit means extends through said building wall.

13. The storage apparatus of claim 12 wherein said outlet conduit means extends through said building wall.

14. The storage apparatus of claim 7 wherein:

said container includes an inlet port;

said inlet conduit means includes an outlet end communicating with said inlet port; and said inlet opening of said inlet conduit means is elevated with respect to said outlet end of said inlet conduit means such that a material delivered into said inlet opening will gravitationally flow into said container.

15. The storage apparatus of claim 7 further comprising means for selectively covering and uncovering said inlet opening of said inlet conduit means.

16. The storage apparatus of claim 15 wherein said means for selectively covering and uncovering said inlet opening comprises a flapper plate.

17. A method of handling a waste fatty material resulting from a food preparation operation, said food preparation operation being located inside a building and said method comprising the steps of (c) placing said waste fatty material in an underground container positioned outside of said building, said container being included in a storage apparatus which further comprises (I) an inlet conduit means for conducting said waste fatty material to said container, said inlet conduit means extending from said container and having an inlet opening positioned inside said building, wherein said waste fatty material is placed in said container by delivering said material into said inlet opening and (ii) an outlet means for removing said waste fatty material from said container, said outlet means including receiving means for temporarily receiving a second conduit; (b) placing said second conduit in said receiving means; and (c) removing said waste fatty material from said container by delivering said waste fatty material through said second conduit.

18. The method of claim 17 wherein said waste fatty material is removed from said container step (c) by pumping said waste fatty material through said second conduit using a vacuum pump.

19. The method of claim 18 wherein, when said waste fatty material is removed from said container in step (c) said second conduit delivers said waste fatty material to a transporting means for transporting said waste fatty material.

20. A method of handling a waste fatty material resulting from a food preparation operation, said method comprising the steps of:

(a) placing said waste fatty material in a container positioned outside of a building, said building having an interior and said container being included in a storage apparatus which further comprises:

an inlet conduit, extending from said container into said interior of said building, for conducting said waste fatty material to said container and an outlet conduit means for conducting said waste fatty material from said container, said outlet conduit means extending from said container and having an outlet opening positioned in said interior of said building, wherein said waste fatty material is placed in said container by delivering said waste fatty material to said container through said inlet conduit;

(b) temporarily extending a third conduit into said interior of said building from a transporting vehicle, said transporting vehicle being positioned outside of said building;

(c) removably securing said third conduit to said outlet opening of said outlet conduit means; and (d) delivering said waste fatty material from said container to said transporting vehicle through said outlet conduit means and said third conduit.

21. The method of claim 20 wherein said building has a building wall and each of said inlet conduit and said outlet conduit means extends through said building wall.

22. The method of claim 20 wherein said waste fatty material is delivered in step (d) from said container to said transporting vehicle by pumping said waste fatty material using a vacuum pump.

* * * * *